US011873640B2

(12) United States Patent
Tremblay

(10) Patent No.: US 11,873,640 B2
(45) Date of Patent: Jan. 16, 2024

(54) APPARATUS FOR FASTENING PREFABRICATED CONCRETE BLOCKS

(71) Applicant: BETON PREFABRIQUE DU QUEBEC INC., Baie Comeau (CA)

(72) Inventor: Jimmy Tremblay, Baie-Comeau (CA)

(73) Assignee: Bréton Préfabrique du Québec Inc., Baie-Comeau (CA)

( * ) Notice: Subject to any disclaimer, the term of this patent is extended or adjusted under 35 U.S.C. 154(b) by 0 days.

(21) Appl. No.: 17/736,125

(22) Filed: May 4, 2022

(65) Prior Publication Data

US 2022/0356699 A1 Nov. 10, 2022

Related U.S. Application Data

(60) Provisional application No. 63/184,905, filed on May 6, 2021.

(51) Int. Cl.
*E04B 1/38* (2006.01)
*E04C 1/41* (2006.01)

(52) U.S. Cl.
CPC ..... *E04B 1/388* (2023.08); *E04C 1/41* (2013.01); *E04B 2001/389* (2023.08)

(58) Field of Classification Search
CPC ..... E04B 1/40; E04B 2001/405; E04B 1/215; E04B 1/388; E04B 2001/389; E04C 1/41; E04F 15/02452
See application file for complete search history.

(56) References Cited

U.S. PATENT DOCUMENTS 3,600,863 A * 8/1971 Nachtsheim ..... E04B 1/215 52/764
3,605,586 A * 9/1971 Bowman ..... E01C 23/023 249/9
3,780,480 A * 12/1973 Cvijanovic ..... E04B 1/215 52/587.1
3,993,341 A * 11/1976 Bentley ..... E04B 5/023 52/587.1
4,996,804 A * 3/1991 Naka ..... E04F 15/02452 52/126.6
5,072,557 A * 12/1991 Naka ..... E04F 15/02476 52/126.6
5,181,359 A * 1/1993 Chana ..... E04B 5/43 52/250
6,604,330 B2 * 8/2003 Repasky ..... E04F 15/02022 411/395
7,980,040 B2 * 7/2011 Pacione ..... E04B 1/28 52/584.1

(Continued)

FOREIGN PATENT DOCUMENTS

KR 101272601 B1 * 10/2012 ..... E04D 11/005
WO WO-2016094453 A1 * 6/2016 ..... E04D 11/005

*Primary Examiner* — Theodore V Adamos
(74) *Attorney, Agent, or Firm* — Philip A. Swain; Equinox IP Inc.

(57) ABSTRACT

A fastening apparatus for two or more prefabricated blocks, in which the apparatus includes a perforated plate, a first block with a step, a connector plate that sized and shaped to engage the step, and an upstanding wall that is spaced apart from the block member. The perforated plate is connected to the wall and extends away from it towards the step. The perforated plate is partially mounted on part of the connector plate so as to sandwich it between the perforated plate and the step.

19 Claims, 4 Drawing Sheets

(56) References Cited

U.S. PATENT DOCUMENTS

| | | | | |
|---|---|---|---|---|
| 9,874,036 | B2 * | 1/2018 | Sun | E04H 1/04 |
| 10,508,434 | B2 * | 12/2019 | Morcous | E04B 1/415 |
| 2003/0033765 | A1 * | 2/2003 | Ting | E04C 3/32<br>52/712 |
| 2009/0277124 | A1 * | 11/2009 | Park | E01D 19/125<br>411/81 |
| 2021/0148109 | A1 * | 5/2021 | Foley | E04B 1/4114 |

* cited by examiner

APPARATUS FOR FASTENING PREFABRICATED CONCRETE BLOCKS

CROSS-REFERENCE TO RELATED APPLICATION

Priority is hereby claimed to previously filed U.S. provisional patent application Ser. No. 63/184,905, filed on May 6, 2021, the contents of which are hereby incorporated by reference.

TECHNICAL FIELD

The present generally concerns construction materials, and more particularly an apparatus for connecting prefabricated concrete blocks at a work site.

BACKGROUND

Concrete blocks of various sizes and shapes can be pre-fabricated away from a construction site and transported to the site for assembly as part of a larger building structure. Generally speaking, when two or more pre-fabricated concrete blocks are to be connected together, they must first be manufactured with connector pieces such as connector rods and the like that extend from the block surface. At the construction site, workers must then maneuver the blocks together so as to align the connecting bits and then once connected, concrete can then be poured between the cracks/gaps to secure the blocks together. This technique is particularly problematic especially when laying the foundation of a building on top of previously located piles. The piles are generally located in a vertical orientation in the ground and anchored using a number of methods known to those skilled in the art. One such method is pile-driving, i.e. the using of continuously applied downward force against the pile to drive it into the ground. Once the desired depth is reached, the construction of the building can begin.

As is well known in the art, the first layer of concrete blocks is generally the most important because if these are not correctly aligned and secured in place, the whole building may be out of alignment, Knowing this problem exists prompted a number of groups to design systems to secure pre-fabricated blocks together. A number of designs exist which sought to address these problems. Examples of these designs are as follows:

- U.S. Pat. No. 7,470,090 to Heppner on Dec. 3, 2008 for "Lifting Bracket System Supported on a Pier for Lifting Foundation";
- U.S. Pat. No. 6,817,810 to Jones on Nov. 16, 2004 for "Piercing device with Adjustable Helical Plate";
- U.S. Pat. No. 6,682,267 to Jones on Jan. 27, 2004 for "Piercing device with Adjustable Helical Plate";
- U.S. Pat. No. 3,931,716 to Payne on Jan. 13, 1976 for "Pile Splice for Concrete and Steel Piles of Various Configuration"; and
- Russian Patent No. RU2583793C1 to Deitrich Investments on Feb. 4, 2015 for "Screw Pile".

Disadvantageously, none of the above designs are capable of on-site use. The designs appear to require pre-fabrication away from the site followed by transportation to the site. While this might be sufficient for small projects, if used to construct large civil engineering projects such as skyscrapers or bridges, this would be prohibitively expensive and cumbersome.

Thus, there is a need for an improved apparatus that can be used at a construction site to permit connecting two or more pre-fabricated blocks together.

BRIEF SUMMARY

Our invention significantly reduces, or essentially eliminates, the problems associated with the designs described above by using a fastening system that allows the attachment of precast or pre-fabricated concrete elements with piles in a simple and economical manner. Our design replaces conventional connections made on site which generally consist of pouring the concrete elements around the head of the pile on which metal elements have been added in order to ensure the connection with the concrete. Furthermore, our fastener apparatus allows the prefabrication of elements which were hitherto believed to be extremely difficult to prefabricate. As part of our design construction, we first modified the pile head by adding a steel base plate to support the prefabricated elements and all the loads applied to them. After this, a metal structure is welded to the pile head of a length that allows it to pass through the prefabricated elements. Finally, the prefabricated elements are made by adding embedded metal elements in the concrete which permit connection with the pile head.

Accordingly, in one embodiment there is provided a fastening apparatus for two or more prefabricated blocks, the apparatus comprising:

- a first perforated plate;
- a first block member having a first stepped portion;
- a first connector plate sized and shaped for engagement with the first stepped portion of the first block member; and
- a first upstanding wall spaced apart from the first block member, the first perforated plate being connected to the first upstanding wall and extending away therefrom towards the first stepped portion, the first perforated plate being partially mounted on a portion of the first connector plate so as to sandwich the first connector plate between the first perforated plate and the first stepped portion.

In one example, the apparatus further comprises:

- a second perforated plate;
- a second block member having a second stepped portion;
- a second connector plate sized and shaped for engagement with the second stepped portion of the second block member; and
- a second upstanding wall spaced apart from the second block member, the second perforated plate being connected to the second upstanding wall and extending away therefrom towards the second stepped portion, the second perforated plate being partially mounted on a portion of the second connector plate so as to sandwich the second connector plate between the second perforated plate and the second stepped portion; the first and second upstanding walls being spaced apart from each other a distance sufficient to receive therein an amount of a filler material.

In one example, the apparatus further includes third and fourth upstanding walls connected to the first and second upstanding walls so as to define a chamber to receive therein the filler material.

In one example, the first stepped portion of the first block member and the second stepped portion of the second block member each includes a first step and a second step, the first step having a first step horizontal ledge, the second step having a second step horizontal ledge, the first step horizontal step ledge being larger than the second step horizontal ledge.

In another example, the first and the second connector plates are shaped to be complementary with the first step and the second step of the respective first and second stepped portions. The first connector plate and the second connector plates are abuttingly and snuggly connected to the first and second steps of the first and the second connector portions.

In one example, the first connector plate and the second connector plate are L-shaped plates.

In another example, the first perforated plate and the second perforated plates are each connected to the respective first upstanding wall and the second upstanding wall, the first and the second perorated plates each being disposed towards the respective first and second stepped portions. The first and second perforated plates are connected generally orthogonal relative to the respective first and second upstanding walls. The first and second perforated plates are connected at 90-degrees relative to the respective first and second upstanding walls.

In one example, the first and second perforated plates are welded to the first and the second upstanding walls.

In one example, the first and second perforated plates are partially mounted on the respective first and second connector plates so that first and second gaps are located between first and second perforated plate ends and the first and second stepped portions.

In one example, the first and second upstanding walls are spaced apart from the first and second block members so that first and second elongate gaps are located between the first and second block members and the first and second upstanding walls.

In one example, first and second strengthening angles are embedded in the first and second block members, the first and second strengthening angles are disposed towards the first and second connecting plates. The first and second strengthening angles are first and second elongate rod members.

In one example, the apparatus further comprises: a third block member having a third stepped portion; and a fourth block member having a fourth stepped portion. The first connector plate is sized and shaped for engagement with the third stepped portion of the third block member; and the second connector plate is sized and shaped for engagement with the fourth stepped portion of the fourth block member.

The first upstanding wall spaced is apart from the third block member, the first perforated plate being connected to the first upstanding wall and extending away therefrom towards the third stepped portion, the first perforated plate being partially mounted on a portion of the first connector plate so as to sandwich the first connector plate between the first perforated plate and the third stepped portion. The second upstanding wall spaced apart from the fourth block member, the second perforated plate being connected to the second upstanding wall and extending away therefrom towards the fourth stepped portion, the second perforated plate being partially mounted on a portion of the second connector plate so as to sandwich the second connector plate between the second perforated plate and the fourth stepped portion. The third stepped portion of the third block member and the fourth stepped portion of the fourth block member each includes a first step and a second step, the first step having a first step horizontal ledge, the second step having a second step horizontal ledge, the first step horizontal step ledge being larger than the second step horizontal ledge.

In yet another example, the first and the second connector plates are shaped to be complementary with the first step and the second step of the respective third and fourth stepped portions. The first connector plate and the second connector plates are abuttingly and snuggly connected to the first and second steps of the third and the fourth connector portions.

In one example, the first perforated plate and the second perforated plates are each connected to the respective first upstanding wall and the second upstanding wall, the first and the second perorated plates each being disposed towards the respective third and fourth stepped portions.

In one example, the first and second upstanding walls are spaced apart from the third and fourth block members so that first and second elongate gaps are located between the third and fourth block members and the first and second upstanding walls.

In one example, third and fourth strengthening angles are embedded in the third and fourth block members, the third and fourth strengthening angles are disposed towards the first and second connecting plates. The third and fourth strengthening angles are third and fourth elongate rod members.

In one example, the filler material is a polymeric foam.

In one example, the first, second, third and fourth block members when fastened together create an indent defined by the first, the second, the third and the fourth stepped portions, the indent being of sufficient size to receive therein an amount of non-shrink grout.

In another example, the first, the second, the third and the fourth block members are mounted on a support plate. The support plate is connected to a pile. The pile is a cylindrical pile.

BRIEF DESCRIPTION OF THE DRAWINGS

These and other features of that described herein will become more apparent from the following description in which reference is made to the appended drawings wherein.

DETAILED DESCRIPTION

Definitions

Unless otherwise specified, the following definitions apply:

The singular forms "a", "an" and "the" include corresponding plural references unless the context clearly dictates otherwise.

As used herein, the term "comprising" is intended to mean that the list of elements following the word "comprising" are required or mandatory but that other elements are optional and may or may not be present.

As used herein, the term "consisting of" is intended to mean including and limited to whatever follows the phrase "consisting of". Thus, the phrase "consisting of" indicates that the listed elements are required or mandatory and that no other elements may be present.

Figure 1:
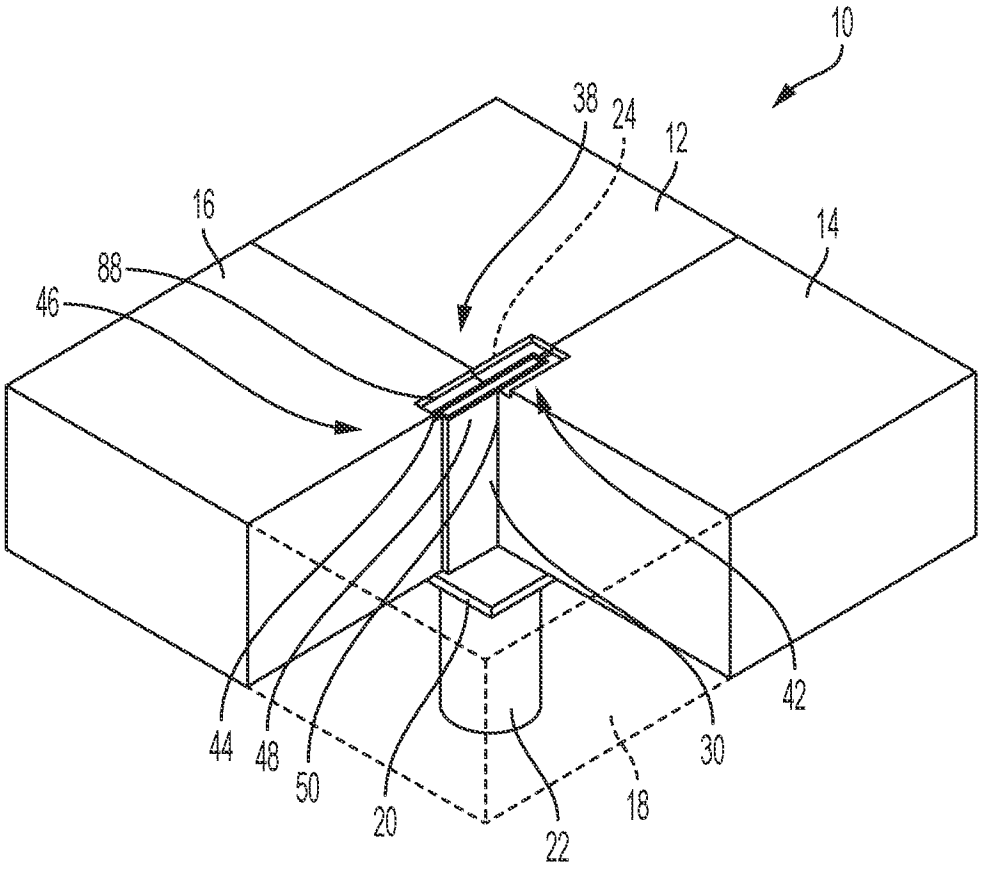
FIG. 1 is a perspective view of an embodiment of an apparatus fastening together four preformed concrete blocks.
Figure 4:
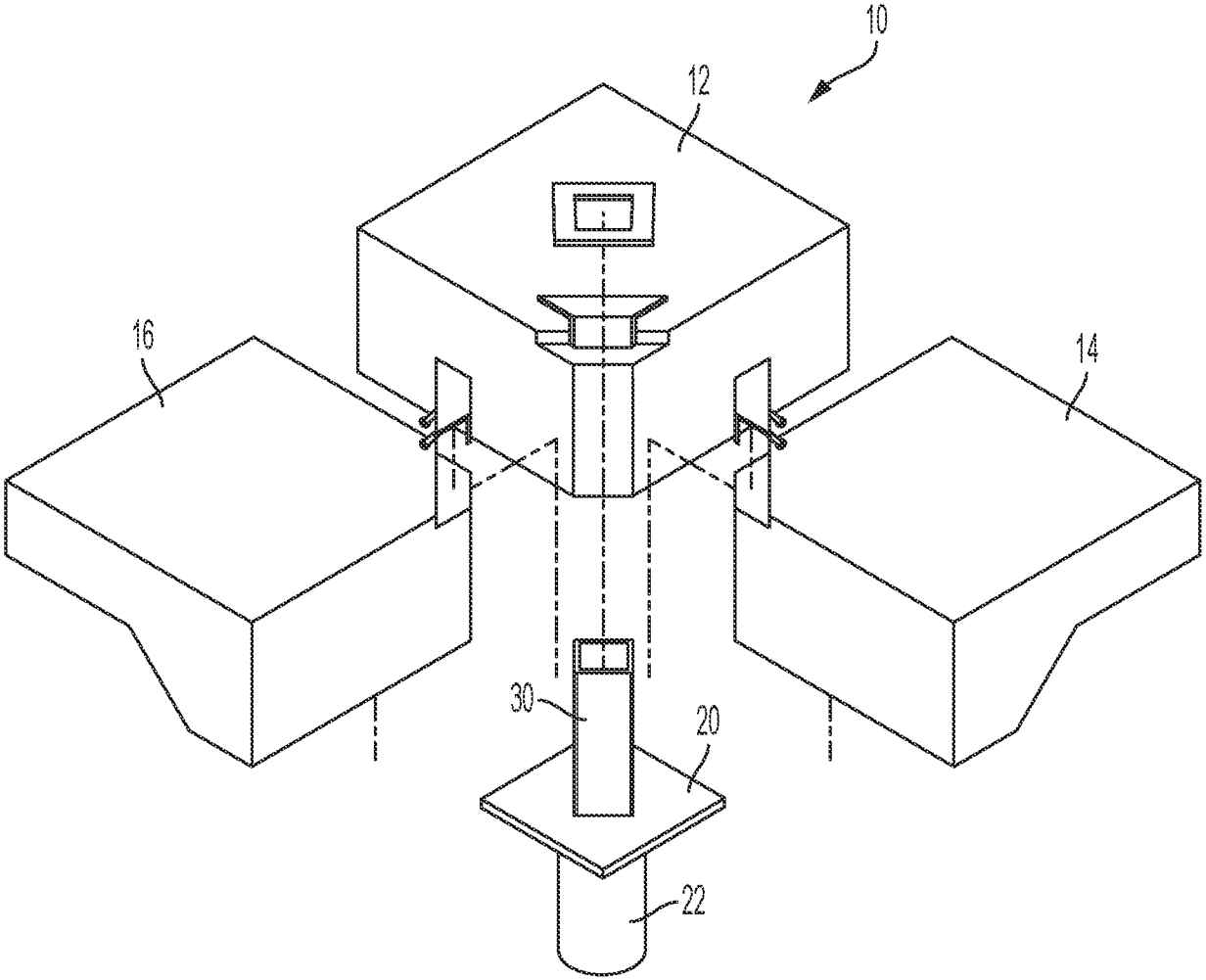
FIG. 4 is a perspective exploded view of the apparatus of FIG. 1.

According to FIGS. 1 and 4, there is illustrated generally at 10, an apparatus (or system) for fastening together two or more prefabricated concrete blocks. A significant advantage of this apparatus is that the prefabricated (or precast) blocks, that are generally made from concrete, can be tailor-made, transported and then assembled on-site with a quick and easy final welding step. In the examples shown, the apparatus 10 includes four prefabricated concrete block members 12, 14, 16, 18 (not shown for illustrative purposes), which are generally cuboid, are fastened (connected) together. When fully assembled, the apparatus 10 includes the concrete block member 12, 14, 16, 18, which are located on top of a steel support plate 20, which is located on a pile 22. The generally cylindrical-shaped pile 22 is typically driven into the ground or a pre-poured concrete slab to permit location of the pile 22 in an orthogonal orientation relative to the ground. A plurality of apparatuses 10 (not shown) can rapidly create the base of a larger structure, such as a building, using the fastening system described herein.

Figure 2:
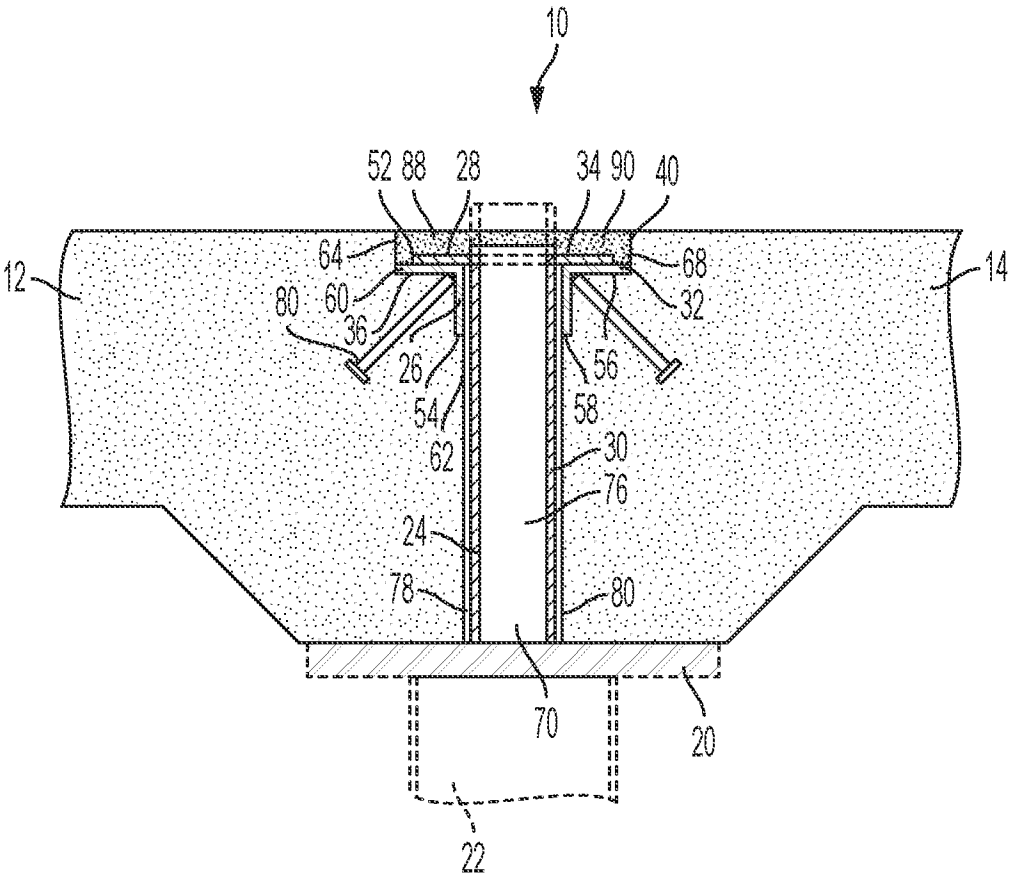
FIG. 2 is a longitudinal cross-sectional view of two preformed concrete blocks connected together and mounted on a pile.
Figure 3:
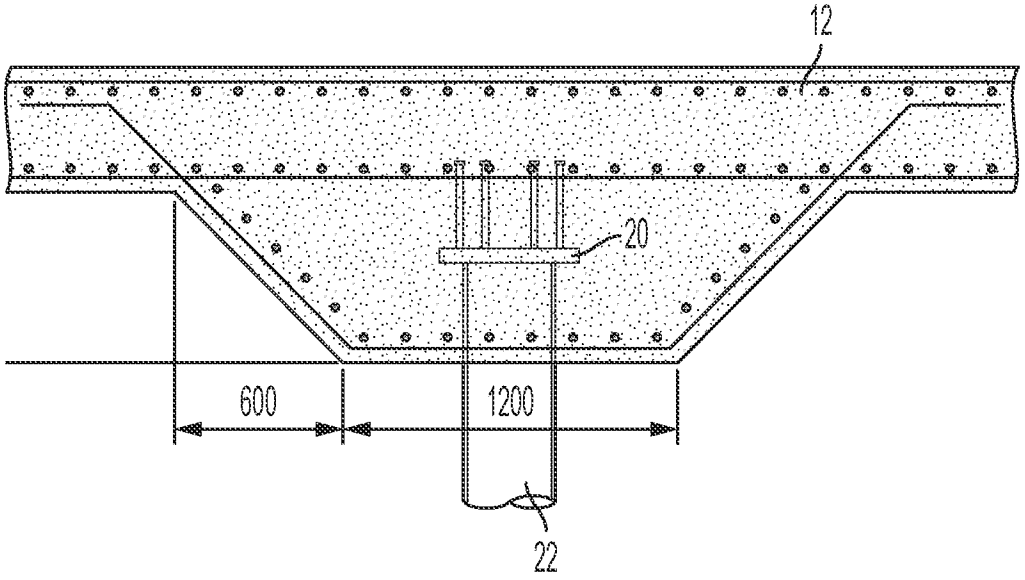
FIG. 3 is a schematic representation of an apparatus showing the location of the pile relative to the concrete block.

Broadly speaking, and as best illustrated in FIGS. 1, 2 and 4, the apparatus 10 includes the first block member 12, a first elongate upstanding wall 24, a first angled connector plate 26 and a first perforated plate member 28. Similarly, the apparatus 10 includes the second block member 14, a second elongate upstanding wall 30, a second angled connector plate 32 and a second perforated plate member 34. The cuboid block member 12, when located for connection includes a first stepped portion 36 that is located at a first upper corner 38 of the block member 12. The cuboid block member 14, when located for connection includes a second stepped portion 40 that is located at a second upper corner 42 of the block member 14. The cuboid block member 16, when located for connection includes a third stepped portion 44 that is located at a third upper corner 46 of the block member 16. The cuboid block member 18, when located for connection include a fourth stepped portion 48 that is located at a fourth upper corner 50 of the block member 18. When located for fastening, the upper corners 38, 42, 46, 50 of the block members 12, 14, 16, 18 are disposed away from the ground. Apart from the stepped portions of each block member, the faces of each block member are planar, forming the cuboid shape.

Referring specifically to FIG. 2, the connection of the first and second block member 12, 14 will now be described. As best viewed in cross-section, the first stepped portion 36 includes first and second steps 52, 54. Similarly, the second stepped portion 40 includes first and second steps 56, 58. In other words, the first step 52 has a first step horizontal ledge 60 and the second step 54 has a second step horizontal ledge 62. To accommodate the stepped portions 36, 40, the first step horizontal step ledge 60 is larger than the second step horizontal ledge 62. The second step horizontal ledge 62 is the same width as the connector plates 26, 32. The first connector plate 26 and the second connector plate 32 are both sized and shaped to respectively engage with the first stepped portion 36 of the first block member 12, the second stepped portion 40 of the second block member 14. The first and the second connector plates 26, 32 are shaped to be complementary with the first steps 52, 56 and the second steps 54, 58 of the respective first and second stepped portions 36, 40. The first connector plate and the second connector plates 26, 32 are abuttingly and snuggly connected to and against the first steps 52, 56 and the second steps 54, 58 of the respective first and second stepped portions 36, 40. In the example shown, the first connector plate 26 and the second connector plate 32 are L-shaped plates. When mounted against the stepped portions 36, 40, the downwardly disposed plate portion of the L-shaped plate is flush (co-planar) with the inwardly facing side wall of the first and second block members 12, 14.

Still referring to FIG. 2, the first upstanding wall 24 is spaced apart from the first block member 12. The first perforated plate member 28 is connected to the first upstanding wall 24 so that it extends away from the wall 24 and is disposed towards the first stepped portion 30. The first perforated plate member 28 is welded to the first upstanding wall 24 at an angle that is generally orthogonal, i.e. 90-degrees to the wall 24. In one example, the plate member 28 is welded to the wall at the construction site once all the other components are assembled. Similarly, the second upstanding wall 30 is spaced apart from the second block member 14. The second perforated plate member 34 is connected to the second upstanding wall 30 so that it extends away from the wall 30 and is disposed towards the second stepped portion 40. The second perforated plate member 34 is also welded to the second upstanding wall 30 at an angle that is generally orthogonal, i.e. 90-degrees to the wall 30. In one example, the plate member 34 is welded to the wall 30 at the construction site once all the other components are assembled. The first and second upstanding walls 24, 30 are spaced apart from the first and second block members 12, 14 so that first and second elongate gaps 78, 80 are located between the first and second block members 12, 14 and the first and second upstanding walls 24, 30. In one example, the first and second elongate gaps 78, 80 are about 10 mm wide.

Still referring to FIG. 2, the first and second perforated plates 28, 34 are partially mounted on respective portions of the first and second connector plates 26, 32 so as to sandwich the first and second connector plates 26, 32 between the first perforated plate 28 and the first stepped portion 36. The first perforated plate 28 extends over about half way the length of the L-shaped plate 26 and stops short of an upstanding wall 62 of the stepped portion 36 of the first block member 12. This truncation defines a first gap 64 between the end of the L-shaped plate 26 and the upstanding wall 62. The second perforated plate 34 extends over about half way the length of the L-shaped plate 32 and stops short of an upstanding wall 66 of the stepped portion 40 of the second block member 14. This truncation defines a second gap 68 between the end of the L-shaped plate 32 and the upstanding wall 66.

Referring to FIGS. 1, 2 and 4, it will be seen to a person of ordinary skill in the art that the elements of the second, the third and the fourth block members are essentially identical to the first block member. When assembled, the first and second upstanding walls 24, 34 are spaced apart from each other a distance sufficient to receive therein an amount of a filler material 70. Third and fourth upstanding walls 72, 74 are also connected to the first and second upstanding walls 24, 34 so as to define a chamber 76 to receive therein the filler material 70. In one example, the filler material 70 is a polymeric foam.

As best seen in FIG. 2, first and second strengthening angles 80, 82 are embedded in the first and second block members 12, 14. The first and second strengthening angles 80, 82 are disposed towards the first and second connecting plates 26, 32 and are welded to each of the connecting plates. The first and second strengthening angles 80, 82 are first and second elongate rod members. Similarly, third and fourth strengthening angles (not shown) are embedded in the third and fourth block members 16, 18. The third and fourth strengthening angles are disposed towards the connecting plates.

Referring back to FIGS. 1 and 4, the third and fourth block member 16, 18 are essentially identical in shape and function compared to the first and second block members 12, 14. The first upstanding wall 24 is spaced is apart from the third block member 16 and the fourth block member 18. The first perforated plate 28 is connected to the first upstanding wall 24 and extends away from it towards the third stepped portion 44 of the third block member 16. The first perforated plate 28 is partially mounted on a portion of the first connector plate 26 so as to sandwich the first connector plate 26 between the first perforated plate 28 and the third stepped portion 44. The second upstanding wall 30 is spaced apart from the fourth block member 18. The second perforated plate 34 is connected to the second upstanding wall 30 and extends away from it towards the fourth stepped portion. The second perforated plate 34 is partially mounted on a portion of the second connector plate 32 so as to sandwich the second connector plate 32 between the second perforated plate 34 and the fourth stepped portion. The third stepped portion 44 of the third block member 16 and the fourth stepped portion 48 of the fourth block member 18 each includes a first step and a second step, the first step has a first step horizontal ledge, the second step has a second step horizontal ledge. As described above for the first and second stepped portions 36, 40, the first step horizontal step ledge is larger than the second step horizontal ledge of the third 44 and the fourth stepped portions 48 of the third and fourth block members. The first and the second connector plates 26, 32 are shaped to be complementary with the first step and the second step of the respective third and fourth stepped portions 44, 48. The first connector plate 26 and the second connector plates 32 are abuttingly and snuggly connected to the first and second steps of the third and the fourth connector portions 44, 48. The first perforated plate 28 and the second perforated plates 34 are each connected to the respective first upstanding wall 24 and the second upstanding wall 30. The first and the second perorated plates 28, 34 are each disposed towards the respective third and fourth stepped portions 44, 48. The first and second upstanding walls 24, 30 are spaced apart from the third and fourth block members 16, 18 so that first and second elongate gaps are located between the third and fourth block members 16, 18 and the first and second upstanding walls 24, 30.

As best seen in FIG. 2, the first, second, third and fourth block members 12, 14, 16, 18 when fastened together create an indent 88 defined by the first, the second, the third and the fourth stepped portions 36, 40, 44, 48. The indent is of sufficient size to receive therein an amount of non-shrink grout 90.

As best seen in FIG. 2, on-site, the ends of the elongate upstanding walls 24, 30 projected away from the indent 88. This is typically cut to the desired size once all the elements have been located. Thereafter the cutting, liquid cement is then poured into the indent 88 to provide sufficient coverage of the elements. In the examples illustrated, the elements are made from steel, or some composite thereof known to those skilled in the art.

Other Embodiments

From the foregoing description, it will be apparent to one of ordinary skill in the art that variations and modifications may be made to the embodiments described herein to adapt it to various usages and conditions.

What is claimed is:

1. A fastening apparatus for two or more prefabricated blocks, the apparatus comprising:

a plurality of block members sized for location on a plate, the plate being mounted on a pile, the block members each having a stepped corner portion;

a plurality of angled connector plates sized and shaped to abuttingly engage the stepped corner portion of each block member;

a plurality of upstanding walls extending from the plate, each wall being located away from the stepped corner portion to define a gap therebetween; and a plurality of perforated plate members connected to an upper end portion of each of the upstanding walls, each perforated plate member extending generally orthogonally from the upper end portion of the upstanding walls and towards the stepped corner portion of each of the block members, each of the angled connector plates being sandwiched between the stepped portions, the perforated plate members and the upstanding walls, the gaps being of size sufficient to receive therein an amount of filler material.

2. The apparatus, according to claim 1, includes:

the plurality of block members comprise four block members sized for location on the plate, the four block members each having the stepped corner portion disposed towards each other;

the plurality of angled connector plates comprise four angled connector plates sized and shaped to abuttingly engage the stepped corner portion of a respective one of the block members;

the plurality of upstanding walls comprise four upstanding walls extending from the plate, each of the upstanding walls being located away from the stepped corner portions to define the gap therebetween; and the plurality of perforated plate members comprise four perforated plate members connected to the upper end portions of each of the four upstanding walls.

3. The apparatus, according to claim 2, in which the upstanding walls are interconnected to define a chamber to receive therein the filler material.

4. The apparatus, according to claim 2, in which the stepped portions of the block members each includes a first step and a second step, the first step having a first step horizontal ledge, the second step having a second step horizontal ledge, the first step horizontal step ledge being larger than the second step horizontal ledge.

5. The apparatus, according to claim 4, in which the connector plates are each shaped to be complementary with the first step and the second step of the respective first and second stepped portions.

6. The apparatus, according to claim 4, in which the connector plates are abuttingly and snuggly connected to the first and second steps of the first and the second connector portions.

7. The apparatus, according to claim 4, in which the perforated plates are each connected to the respective upstanding walls, the perforated plates each being disposed towards the respective first and second stepped portions.

8. The apparatus, according to claim 7, in which the perforated plates are connected generally orthogonal relative to the respective upstanding walls.

9. The apparatus, according to claim 8, in which the perforated plates are connected at 90-degrees relative to the respective upstanding walls.

10. The apparatus, according to claim 4, in which the perforated plates are partially mounted on the connector plates so that first and second gaps are located between first and second perforated plate ends and the first and second stepped portions.

11. The apparatus, according to claim 4, in which the upstanding walls are spaced apart from the block members so that elongate gaps are located between the block members and the upstanding walls.

12. The apparatus, according to claim 2, in which the four block members when fastened together define an indent defined by the stepped portions, the indent being of sufficient size to receive therein an amount of non-shrink grout.

13. The apparatus, according to claim 1, in which the connector plates are L-shaped plates.

14. The apparatus, according to claim 1, in which the perforated plates are welded to the first upstanding walls.

15. The apparatus, according to claim 1, in which strengthening angles are embedded in the block members, the strengthening angles are disposed towards the connecting plates.

16. The apparatus, according to claim 15, in which the strengthening angles are elongate rod members.

17. The apparatus, according to claim 1, in which the filler material is a polymeric foam.

18. The apparatus, according to claim 1, in which the pile is a cylindrical pile.

19. The apparatus, according to claim 1, in which the upstanding walls are connected to define an elongate cuboid chamber extending from the plate.

* * * * *